US009300053B2

(12) United States Patent
Wunsch et al.

(10) Patent No.: US 9,300,053 B2
(45) Date of Patent: Mar. 29, 2016

(54) WIDE BAND EMBEDDED ARMOR ANTENNA USING DOUBLE PARASITIC ELEMENTS

(75) Inventors: Gregory J. Wunsch, Milford, NH (US); Paul E. Gili, Mason, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 220 days.

(21) Appl. No.: 13/879,641

(22) PCT Filed: Aug. 1, 2012

(86) PCT No.: PCT/US2012/049093

§ 371 (c)(1), (2), (4) Date: Apr. 16, 2013

(87) PCT Pub. No.: WO2013/066451

PCT Pub. Date: May 10, 2013

(65) Prior Publication Data

US 2014/0002317 A1 Jan. 2, 2014

Related U.S. Application Data

(60) Provisional application No. 61/522,751, filed on Aug. 12, 2011.

(51) Int. Cl.

| | |
|---|---|
| ***H01Q 1/32*** | (2006.01) |
| ***H01Q 9/28*** | (2006.01) |
| ***H01Q 3/30*** | (2006.01) |
| ***H01Q 19/30*** | (2006.01) |
| ***F41H 5/02*** | (2006.01) |
| ***F41H 5/04*** | (2006.01) |

(52) U.S. Cl.

CPC ..... *H01Q 9/285* (2013.01); *F41H 5/023* (2013.01); *F41H 5/0428* (2013.01); *H01Q 1/3283* (2013.01); *H01Q 3/30* (2013.01); *H01Q 19/30* (2013.01)

(58) Field of Classification Search

USPC ..... 343/713, 711, 718, 872, 893, 700 MS

See application file for complete search history.

(56) References Cited

U.S. PATENT DOCUMENTS

| | | | | |
|---|---|---|---|---|
| 4,804,967 | A | 2/1989 | Ohe et al. | |
| 4,812,855 | A * | 3/1989 | Coe et al. | 343/818 |
| 5,444,453 | A * | 8/1995 | Lalezari | 343/700 MS |
| 6,333,719 | B1 * | 12/2001 | Varadan et al. | 343/787 |
| 7,170,440 | B1 * | 1/2007 | Beckner | 342/22 |
| 2004/0056801 | A1 | 3/2004 | Apostolos | |
| 2005/0122269 | A1 * | 6/2005 | Frazier | 343/703 |
| 2008/0018545 | A1 | 1/2008 | Kaplan et al. | |
| 2011/0260935 | A1 * | 10/2011 | Bortoin et al. | 343/713 |
| 2012/0293380 | A1 * | 11/2012 | Apostolos et al. | 343/713 |

* cited by examiner

*Primary Examiner* — Sue A Purvis
*Assistant Examiner* — Jae Kim
(74) *Attorney, Agent, or Firm* — Daniel J. Long; Hayes Soloway PC

(57) ABSTRACT

For use with an armored vehicle, a wideband embedded armor antenna is provided. The antenna includes an armor layer mounted to the armored vehicle. A driven dipole is mounted between the armor layer and the vehicle, the dipole operating in the UHF band. A first parasitically driven dipole is mounted on the outside of the armor layer. A second parasitically driven dipole is mounted between the driven dipole and the vehicle. A feed for the driven dipole is provided which does not pierce the armor layer.

21 Claims, 7 Drawing Sheets

WIDE BAND EMBEDDED ARMOR ANTENNA USING DOUBLE PARASITIC ELEMENTS

RELATED APPLICATIONS

This Application claims rights under 35 USC §119(e) from U.S. Application Ser. No. 61/522,751 filed Aug. 12, 2011, the contents of which are incorporated herein by reference.

STATEMENT OF GOVERNMENT INTEREST

The invention was made with United States Government assistance under Contract No. W15P7T-09-C-S485 awarded by the US Army. The United States Government has certain rights in the invention.

FIELD OF THE INVENTION

This invention relates to an antenna utilized on armored vehicles and more particularly to an armor-embedded parasitically-fed antenna system.

BACKGROUND OF THE INVENTION

As described in U.S. patent application Ser. No. 13/473,132 filed May 16, 2012 incorporated herein by reference, it is desirable to provide a thin structure for an antenna embedded in an armor panel and more particularly to provide a parasitic element, on top of the armor layer so that when driving the antenna there are no apertures in the armor which would degrade performance. In one embodiment the aperture-less embedded antenna system includes a direct fed dipole on the underneath side of the armor layer such that the armor layer is not pierced. There is an identical dipole on the top of the armor layer that is parasitically fed by the driven dipole. In one embodiment the dipoles are in the form of bowties.

As described in the above-identified patent application, it is desirable to replace antennas such as whip antennas on tanks, armored vehicles and the like with broadband antennas that are conformal to the vehicle itself.

Having a forest of antennas that extend from the armored vehicle is undesirable because they are susceptible to damage and attack. It is therefore desirable to be able to provide an antenna system which is embedded in the armor such that the armor protects the embedded antenna both against explosive attacks and ballistic penetration while at the same time eliminating the need for antenna whips, and the like which are easily blown off with explosive charges, thereby precluding communication with the vehicle.

It is noted that the thin structure of present armor panels presents the greatest challenge to antenna design. Whether the panel is metal backed itself or is mounted on a metal vehicle, the close proximity of a conductive surface to a radiating element creates a ground plane that is too close to the element. As will be appreciated in traditional antenna design, the ground plane is spaced at least a quarter wavelength away from any driven element. However, when dealing with armor for vehicles such as tanks and the like, the spacing between the ground plane and the driven element of the antenna is on the order of hundredths of a wavelength.

While initially thought that this limitation would be a disqualifying factor in the antenna design, it has been shown that a thin antenna structure can be created which does not rely on deep cavities behind the elements. However, it has been found that the close spacing described in the above patent application as well as other factors limits bandwidth and gain and results in non-optimal VSWR across the desired bandwidth for instance between 225 GHz and 450 GHz.

Note, deep cavity structures have been described in U.S. Pat. No. 6,833,815 which relates to Cavity Embedded Meanderline Loaded Antennas. In this patent the antenna described is a conformal antenna which is cavity-backed.

In one embodiment of this Cavity Embedded Meanderline Antenna a bowtie dipole is utilized, with the distal ends of the dipole being coupled to surrounding metal utilizing a meanderline structure. The question becomes how one can better configure such dipole antenna into a thin structure for use with at armor plates.

SUMMARY OF THE INVENTION

While a single parasitic/driver element combination has been used in a thin stacked element array as an embedded armor antenna, it has been found that the thin stacked element array achievable using a driven bowtie dipole to the inside of an alumina tile armor plate and a parasitic element on the outside of the armor plate can be improved in terms of boresight gain and VSWR by placing a bottom parasitic element between the driven bowtie and the body of the vehicle in which the subject antenna is embedded. Further improvement is achieved by spacing the bottom or inside parasitic antenna from the vehicle body to form an air gap.

In order to achieve satisfactory embedded antenna performance, in the subject invention bowtie dipoles are used both as the directly driven element and for both parasitically-driven dipole elements. Moreover, along with the air gap each bowtie element is provided with a resistor between the dipole elements, the values of which optimize antenna performance. Additionally, the lengths of the driven element and the parasitical elements are adjusted to maximize gain, minimize VSWR over a wide bandwidth and increase efficiency, with the gain being greater than −1, dBi over the entire bandwidth of the antenna, in one embodiment 225-450 GHz.

In one embodiment a plurality of armor embedded panels, each carrying the driven dipole and the two parasitically-driven elements, are located side by side, for instance on a tank, and may driven in phase or may be phased to provide a sharp antenna lobe in a given direction. Thus, the gain in a particular direction may be increased with traditional antenna steering. As will be appreciated, for a steerable beam one can obtain increased gain in a particular pointing direction.

With a vertically polarized four panel array, the gain in the horizontal direction has been found to exceed −1 dBi across the entire bandwidth. It has also been found that with the dual parasitic elements and the air gap the VSWR across at least the 225-450 MHz band can be made to be less than 3:1.

In summary, an extremely thin embedded antenna for an armor-carrying vehicle utilizes a dipole driven element to the inside of the armor plate and a pair of parasitically-driven dipole elements to either side of the driven element, with the interior or back parasitic element and an air gap providing improved forward gain and antenna matching characteristics over the single parasitic element embedded antennas described in the above patent application.

BRIEF DESCRIPTION OF THE DRAWINGS

These and other features of the subject invention will be better understood in connection with the Detailed Description, in conjunction with the Drawings, of which.

DETAILED DESCRIPTION

Prior to discussion of the specifics of the subject antenna system, it is noted that the thin structure of the armor panel is the greatest challenge to the antenna design. Whether the panel is metal-backed itself or is mounted on a metal vehicle, the close proximity of a conductive surface creates a groundplane to the radiating element. A conventional design would have the groundplane spaced at least a quarter-wavelength away. However, one is typically dealing with spacing more on the order of hundredths of a wavelength. It was found that this was not a disqualifying factor in antenna designs, and an armor embedded antenna with an outside parasitic element provided adequate results. The present antenna, which is a modification of the original design, improves on this original design by adding an additional parasitically driven element.

Figure 1:
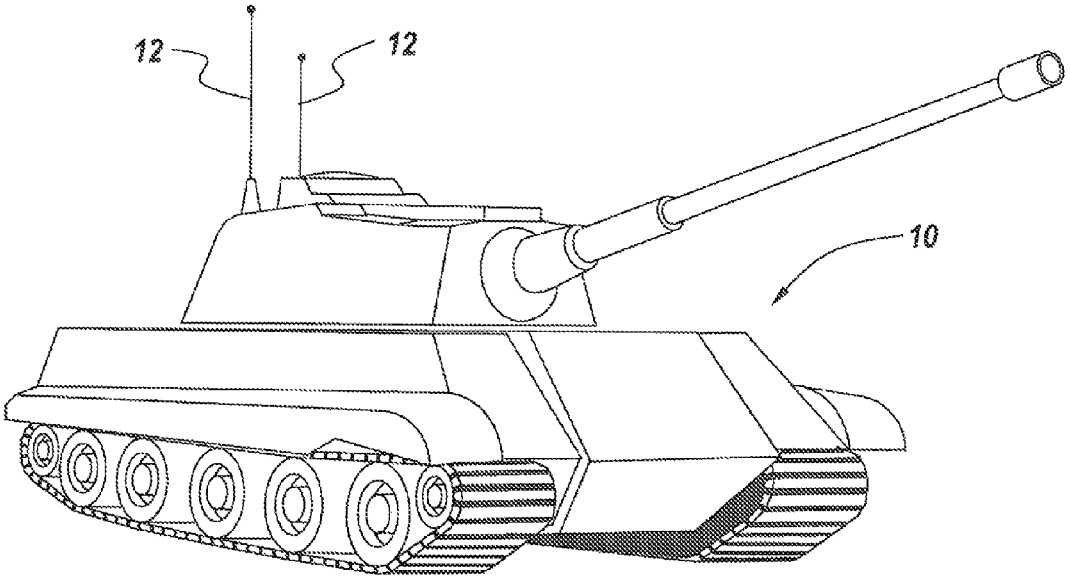
Fig. 1 (Prior Art)
FIG. 1 is a diagrammatic illustration of a tank sporting a pair of prior art whip antennas which are exceedingly vulnerable to enemy fire and which are subject to damage.

Referring now to FIG. 1, in the prior art a tank 10 or other armored vehicle may be provided with a number of whip antennas 12 which extend above the vehicle and which are tuned to various frequency bands.

The problem with such a configuration is that the whips are extremely vulnerable to explosive destruction as well as being torn off the vehicle by overhead limbs and the like. Moreover there is considerable cross talk or interference between the antennas.

It will be appreciated that in order to cover the bands of interest for communication with such a vehicle a number of bands are required. It would be desirable to have communication antennas for such vehicles that operate in a 225 MHz to 425 MHz band. However, antennas that are wideband enough do not exist other than in whip form.

Figure 2:
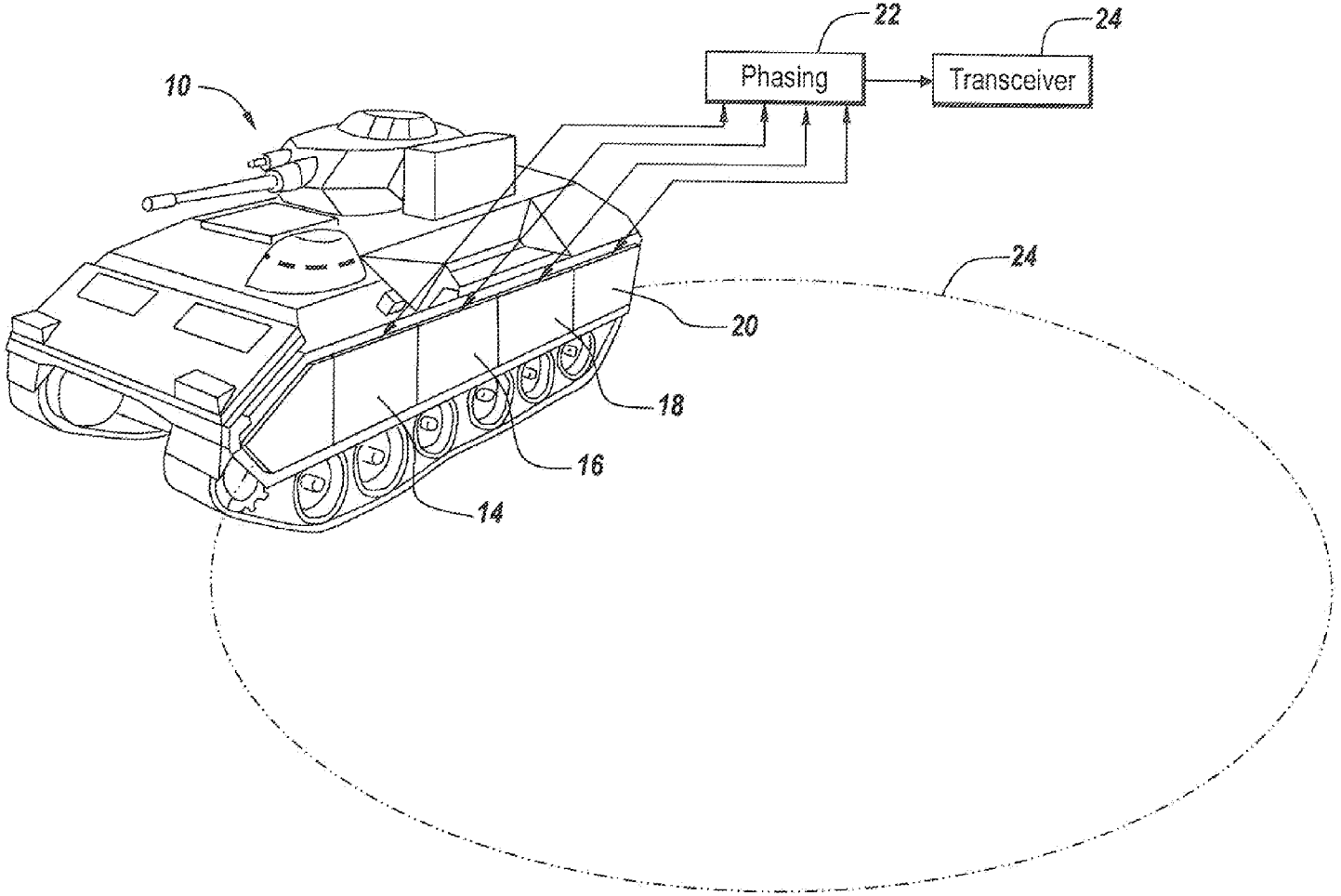
FIG. 2 is a diagrammatic illustration of the utilization of the subject embedded dipoles in a number of adjacent armor panels located on the side of a tank showing the ability to phase the embedded bowties for directional purposes, with the bowties when fed in parallel providing a 180° pattern to each side of the tank.

Referring now to FIG. 2, it is the purpose of the subject invention to provide a conformal embedded antenna structure for vehicle 10 in which embedded antenna structures are provided in plates 14, 16, 18 and 20 that when appropriately phased by a phasing network 22 result in an antenna lobe 24 which as illustrated has a 180° azimuthal coverage. Providing the tank with embedded antenna plates on both sides provides a 360° coverage.

The antennas are capable of being used in a transmit and receive mode such that a transceiver 24 can listen for signals in 180° about the horizon, or can transmit signals from the transceiver through the panel-embedded antennas with an antenna pattern such as that shown by reference character 24.

The challenge therefore is to be able to provide a panel-embedded thin antenna structure that provides close to 180° coverage per side and yet has an ultra wideband coverage characteristic and improved gain and efficiency.

Figure 3:
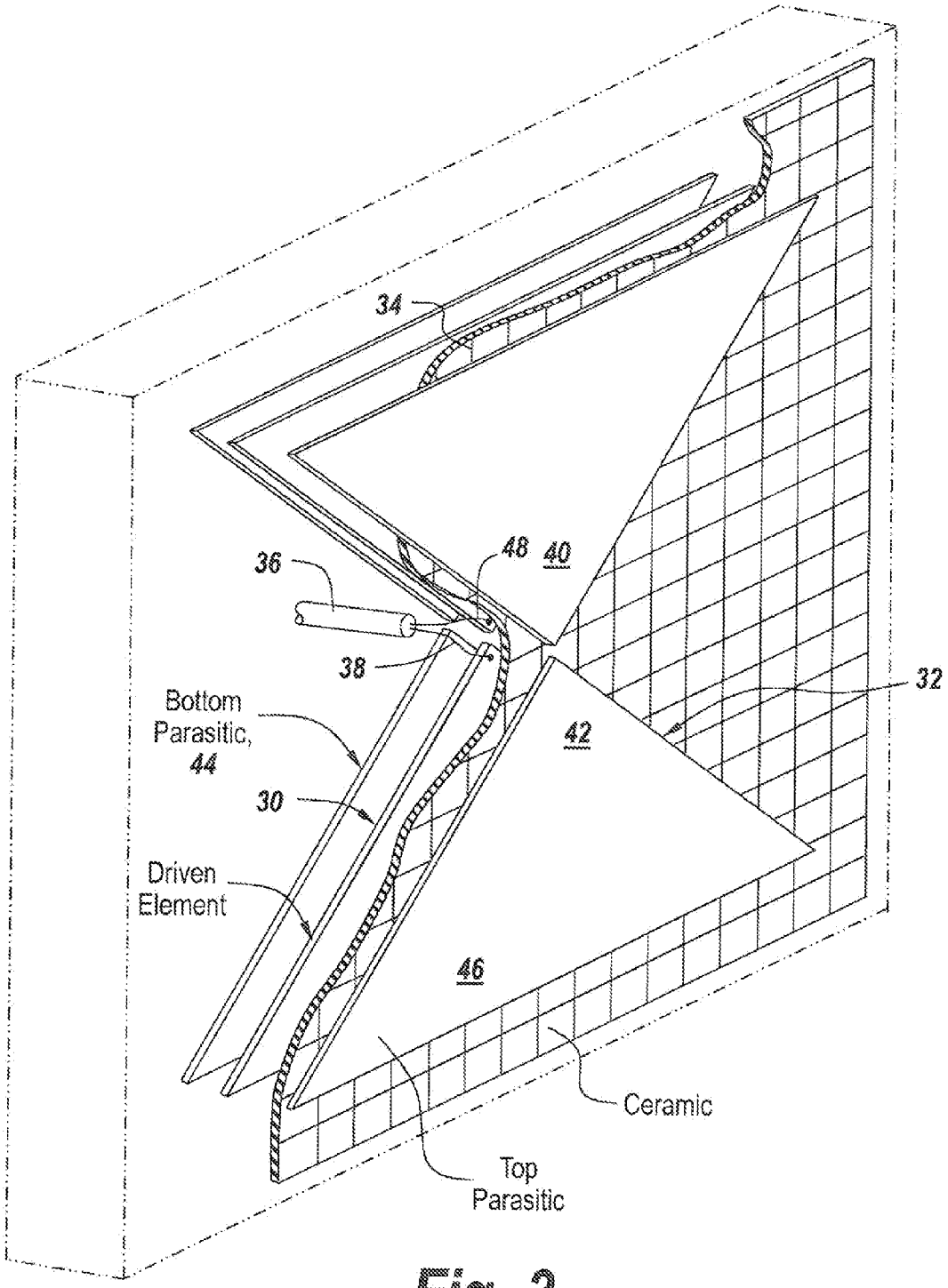
FIG. 3 is a diagrammatic illustration of one of the panels of FIG. 2 illustrating a bowtie driven element to the inside of a armor layer, with a parasitically-driven bowtie to the outside of the armor layer and a parasitically-driven bowtie between the driven element and a vehicle body.

In order to do so and referring now to FIG. 3, a driven dipole element 30 is surrounded by parasitic elements 32 and 44 in the form of bowtie dipoles, with the bottom parasitic element improving the operation of the original antenna. Here a pair of dipoles 30 and 32 are located to either side of an alumina tile armor layer 34 such that the dipole 30 is driven by a transmission line 36 having conductors 38 and 40 which do not pierce the armor layer 34 tiles. The result is an unapertured armor layer in which energy is coupled to an inner bowtie without having to provide holes in the armor plate.

Bowtie dipole 32 is parasitically driven by bowtie dipole 30 to provide a certain amount of gain. However, it was found that this gain could be improved by locating a bottom parasitic dipole 44 between driven element 30 and the vehicle, along with providing an air gap between the bottom parasitic dipole and the metallic vehicle body.

Figure 4:
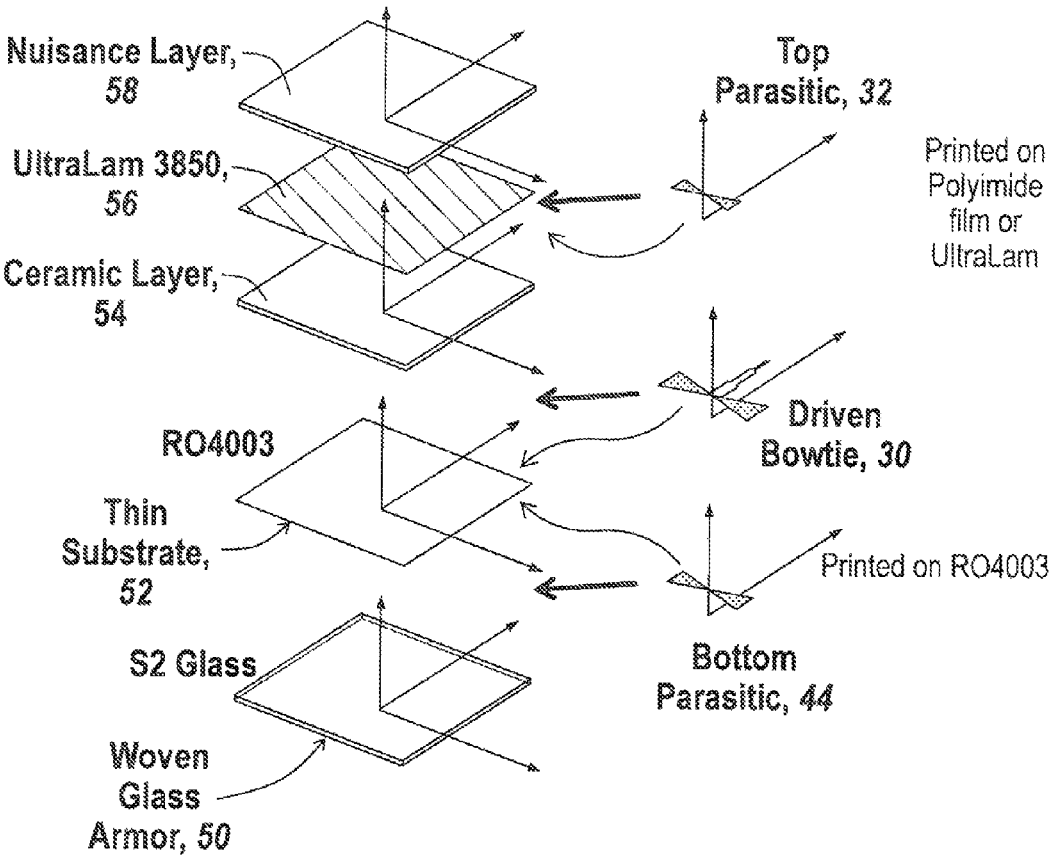
FIG. 4 is a diagrammatic illustration of the construction of the embedded armor antenna of FIG. 3.

Referring now to FIG. 4, the construction of the subject parasitic embedded antenna is as follows. Going from the base one has a woven glass S2 glass armor layer 50 on top of which is provided a thin substrate 52 of RO4003 material. The bottom parasitic dipole 44 is patterned onto the underneath side of substrate 52, with the driven bowtie patterned on the top side of this thin substrate.

On top of the thin substrate is a ceramic layer 54, on top of which is a thin layer 56 of UltraLam 3850 or a polymide, with the top parasitic element patterned on the underside of layer 56. Thereafter a so-called nuisance layer 58 is placed on top of the structure.

Figure 5:
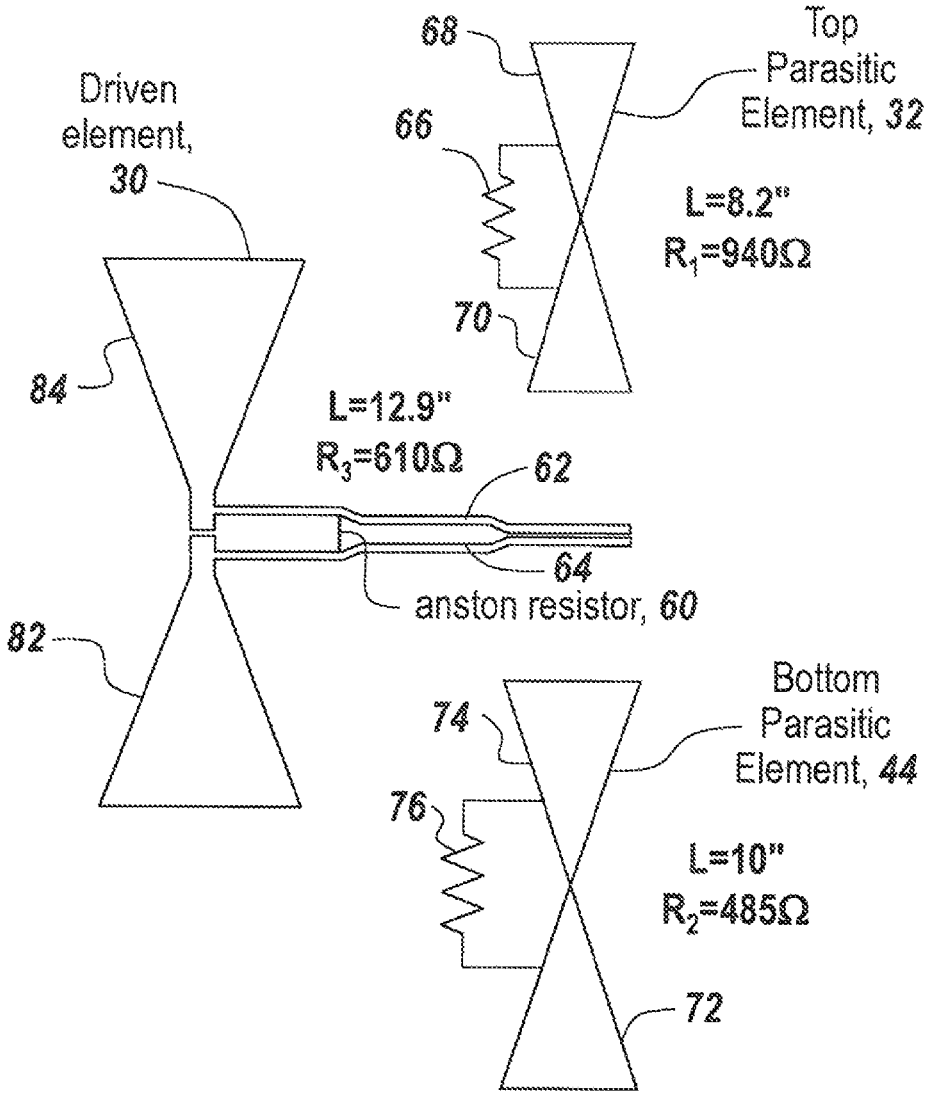
FIG. 5 is a diagrammatic illustration of the bowtie elements of the antenna of FIG. 3 showing critical dimensions and the use of resistors at the junctions of the bowtie elements.

Referring to FIG. 5 an optimal configuration for the subject antenna shows that the driven element, top parasitic element and bottom parasitic element are each provided with a resistor between the elements of associated dipoles, with the resistors provided with values that optimize performance.

Here it can be seen that driven element 30 is provided with a resistor 60 between the feedlines 62 and 64. Note that these resistors can take the form of thin film resistors. In the optimal case, the length of the driven element is 12.9 inches, whereas the value of the resistor between feedline elements 62 and 64 is 610 ohms.

Top parasitic element 32 has a resistor 66 across dipole elements 68 and 70, with the length of the top parasitic element being 8.2 inches and with the value of resistor 66 being 940 ohms.

Referring to the bottom parasitic element, this is composed of dipole elements 72 and 74 with a resistor 76 therebetween. The optimal length of the bottom parasitic element is 10 inches, whereas the value of resistor 76 is 485 ohms.

Figure 6:
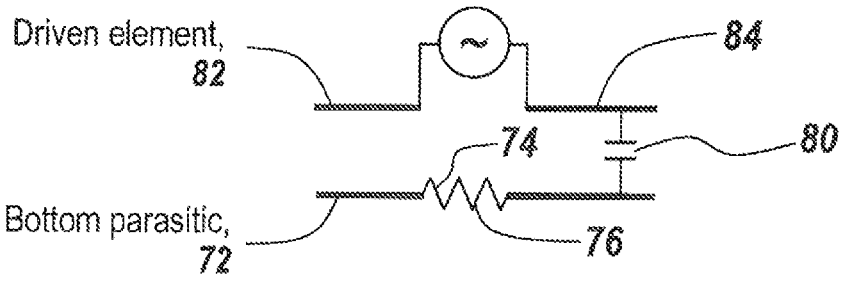
FIG. 6 is a schematic drawing showing the capacitance effect of the bottom parasitic element.

Referring to FIG. 6, the effect of providing the bottom parasitic element along with resistor 76 is a capacitance coupling 80 between driven element 30 and dipole elements 82 and 84.

It is purpose of this capacitance effect is to lower the operating frequency of the antenna such that the parasitic element on the bottom acts like an RC circuit to extend the lower band edge of the antenna down to 225 GHz. It also provides a VSWR less than 3:1, with the length of the bottom parasitic element governing capacitance coupling.

It is noted that by variation of the value of resistor 76 and the lengths of the bottom parasitic element one can vary the capacitance effect and thus optimize the VSWR and gain of the antenna.

It is noted that the lower parasitic element is shorter than the driven element, as is the top parasitic element.

Figure 7:
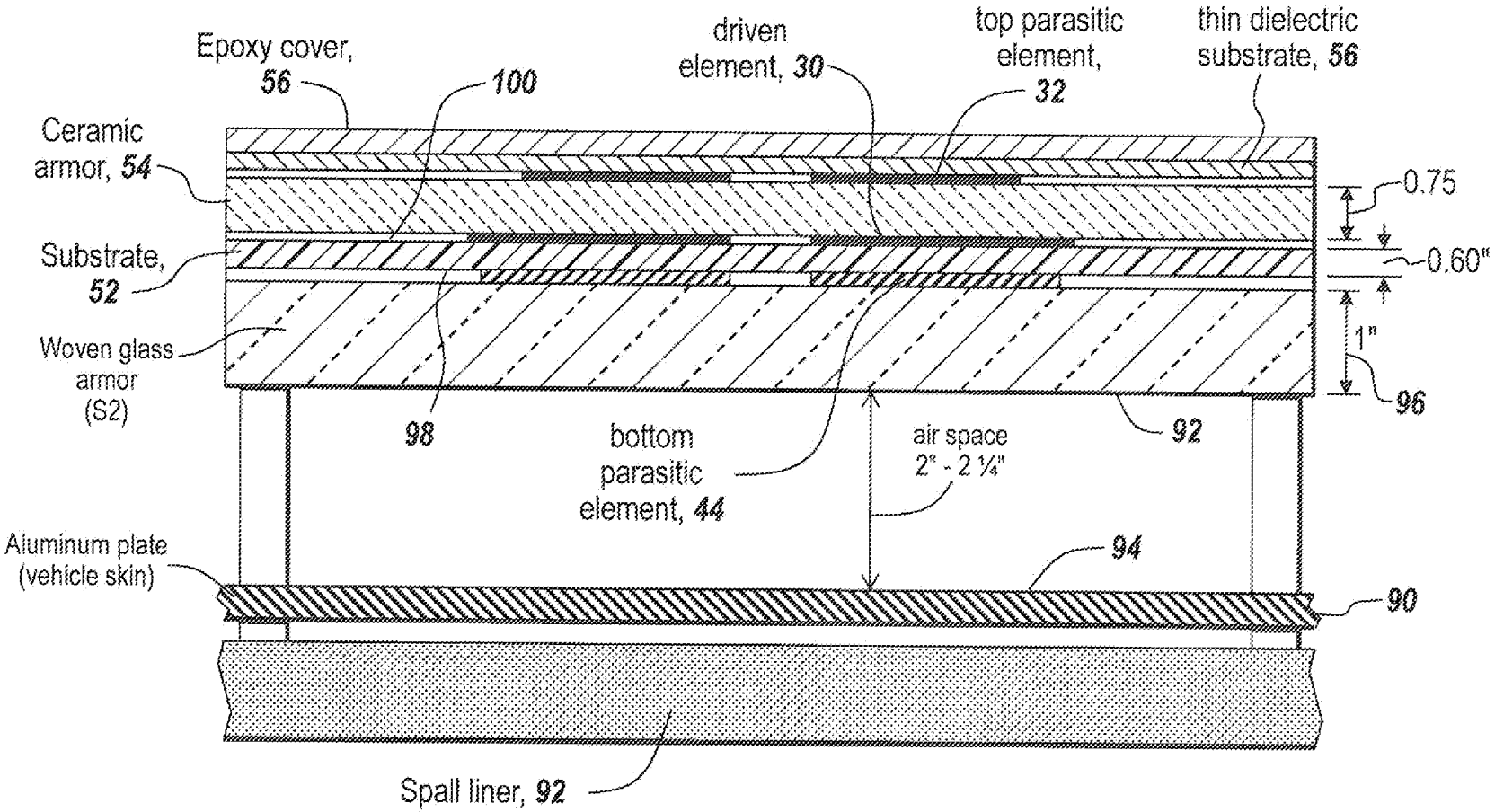
FIG. 7 is a cross sectional view of the embedded thin antenna of FIG. 3 illustrating not only a driven dipole and parasitically-driven dipoles, but also the air gap beneath the bottom parasitic element.

Referring now to FIG. 7 a cross section the subject antenna is illustrated in which the layers are built up from the vehicle body, in this case an aluminum plate 90, behind which a spall liner 92 is located.

Woven glass 82 armor layer 50 has an underside 92 spaced from the top side 94 of the aluminum plate ground plane by a distance of 2 inches to 2¼ inches. It has been found that in addition to the capacitance effect described in FIG. 6, the air gap or air space provides better isolation from the ground plane, at the same time improving gain and VSWR over a 2:1 bandwidth.

As illustrated by arrow 96 the thickness of the woven glass armor layer is approximately 1 inch, with the bottom parasitic element 44 patterned onto the bottom 98 of substrate 52. Here the substrate 52 has a thickness of 0.060 inches. Note, driven element 30 is patterned on the top surface 100 of this thin substrate.

Ceramic armor in the form of a ceramic armor layer 54 is positioned on top of the driven elementand in one embodiment has a thickness of 0.75 inches.

On top of the ceramic armor layer is a thin dielectric substrate 56, with the top parasitic element 32 patterned on the underneath side of this substrate. Thereafter nuisance layer 56, here an epoxy cover, is placed on top of the structure to complete the antenna.

As mentioned hereinbefore the originally designed armor embedded antenna did not have an optimal bandwidth or VSWR over the entire 225 GHz to 450 GHz band. It was found that the prior antenna, while operational, was not as efficient as it could be in. This resulted in reduced radiated power due to the fact that radiation was reflected back towards the generator of the RF energy. While lossy epoxy material was placed on the antenna to reduce the reflected power, the epoxy material did not work sufficiently well.

The solution to improvement of the originally designed antenna was to provide the aforementioned bottom parasitic element which acts like an RC circuit to provide additional capacitance from the parasitic element to the driven element. Secondly, the aforementioned resistors were placed at the junctions of the dipole elements. Thirdly, the lengths of the parasitic elements were adjusted with respect to the driven element to change the capacitance and therefore optimize the VSWR and gain of this antenna. Fourthly, further optimization was provided by the aforementioned air gap to obtain additional separation from the ground plane for avoiding shorting of the antenna as well as avoiding poor impedance matching and poor bandwidth. Moreover, the air gap increases ballistic penetration resistance.

It is noted that the gain throughout the bandwidth has been shown to be greater than −1 dBi, and significantly better across the upper portion of the band.

The benefit of the bottom parasitic and other elements of this antenna includes a better gain over the bandwidth, better VSWR and no deleterious effect on the ballistic characteristics of the antenna.

Note bowtie configurations are utilized to broaden the bandwidth because impedance does not markedly change with frequency.

Figure 8:
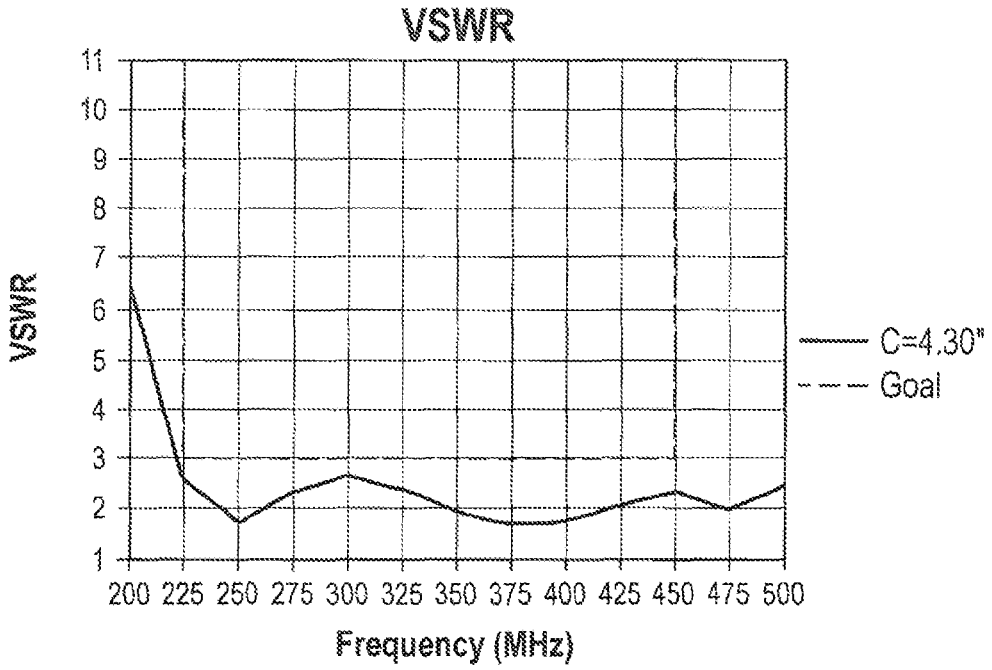
FIG. 8 is a graph showing VSWR, illustrating that the VSWR for the antenna of FIG. 3 can be kept to under 3:1 from 225 GHz-450 GHz; and, FIG. 9 is a graph showing boresight gain vs. frequency for the antenna of FIG. 3.

The above operation is confirmed in FIG. 8 in which VSWR is graphed against frequency. Note that the dotted line indicates the goal of having the VSWR under 3:1, with the diagram illustrating that the average VSWR is around 2:1.

Figure 9:
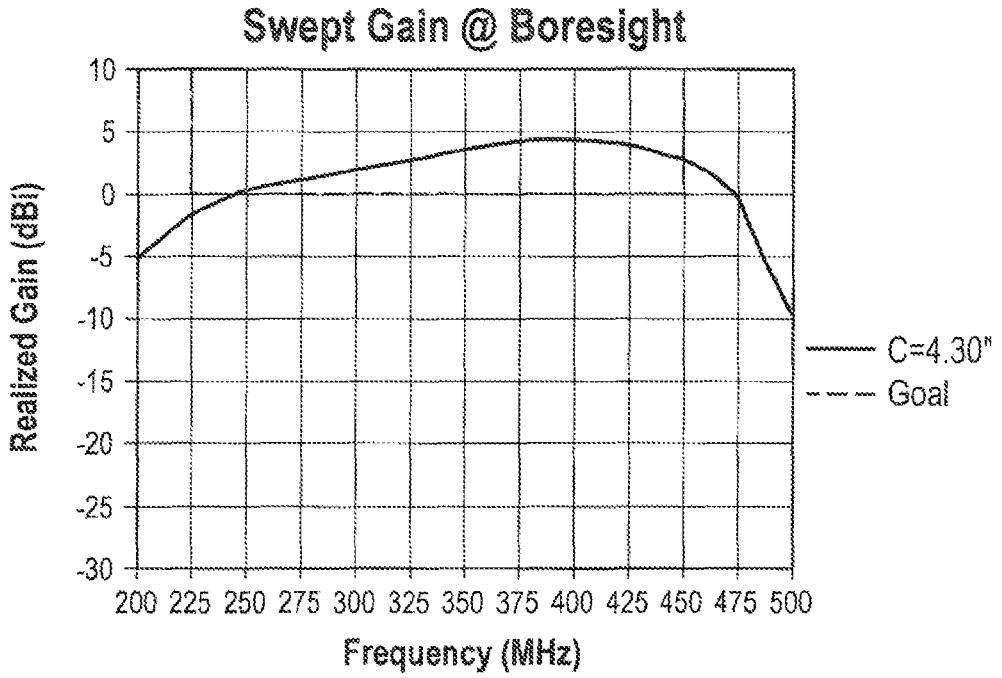

Referring to FIG. 9, what is shown is a graph of the swept gain at the boresight versus frequency, with the goal being better than 0 dBi gain. Here it can be seen that the gain for the subject antenna at the low end is above −1 dBi and is considerably above 0 dBi for the remainder of the bandwidth.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A wideband embedded armor antenna, comprising:

an armor layer mounted to a vehicle having a conductive skin;

a driven dipole in a first plane between said armor layer and said vehicle;

a first parasitically driven dipole in a second plane on the outside of said armor layer;

a second parasitically driven dipole in a third plane between said driven dipole and said vehicle, said second parasitically driven dipole spaced from said driven dipole capacitively coupling said driven dipole to said second parasitically driven dipole, said second parasitically driven dipole having two segments;

a resistor between said two dipole segments, wherein said resistor and said capacitive coupling form an RC circuit that lowers the frequency of said antenna, whereby said RC circuit tunes out inductance that causes destructive interference and diminishes gain, such that said antenna can operate in close proximity to said skin without shorting out said antenna;

a feed for said driven dipole which does not pierce said armor layer, whereby the antenna structure is embedded in the armor layer without altering the characteristics of said armor layer; and wherein a gain across a frequency band associated with said dipoles is at least −1 dBi.

2. The antenna of claim 1, wherein the frequency band associated with said dipoles includes the UHF band.

3. The antenna of claim 2, wherein said UHF band extends from 225 MHz to 450 MHz.

4. The antenna of claim 1, wherein said second parasitically driven dipole is air gap spaced from said vehicle.

5. The antenna of claim 1, and further including resistors between the elements of the dipoles.

6. The antenna of claim 1, wherein said dipoles include bowtie shaped elements.

7. The antenna of claim 6, wherein said bowtie shaped elements are in the form of triangularly-shaped elements.

8. The antenna of claim 1, and further including a number of armor plates attached to the side of said vehicle, each of said armor plates including an embedded driven dipole antenna and an exterior parasitically-driven dipole antenna, along with an interior parasitically-driven dipole antenna and further including a phasing module for driving the antennas in said panels.

9. The antenna of claim 8, wherein said phasing module drives the embedded antennas in said panels in-phase.

10. The antenna of claim 8, wherein said phasing module phases the feeds for said embedded antennas so as to provide a steerable beam therefrom.

11. For use with an armored vehicle, a wideband embedded armor antenna, comprising:

an armor layer mounted to au armored vehicle having a conductive skin;

a driven dipole in one plane between said armor layer and said vehicle, said dipole operating in the UHF band;

a first parasitically driven dipole in a second plane on the outside of said armor layer;

a second parasitically driven dipole in a third plane between said driven dipole and said vehicle, said second parasitically driven dipole spaced from said driven dipole capacitively coupling said driven dipole to said second parasitically driven dipole, said second parasitically-driven dipole having two segments;

a resistor between said two dipole segments, wherein said resistor and said capacitive coupling form an RC circuit that lowers the frequency of said antenna, whereby said RC circuit tunes out inductance that causes destructive interference and diminishes gain, such that said antenna can operate in close proximity to said skin without shorting out said antenna; and, a feed for said driven dipole which does not pierce said armor layer, whereby the antenna structure is embedded in the armor layer without altering the characteristics of said armor layer.

12. The antenna of claim 11, wherein said UHF band extends from 225 MHz to 450 MHz.

13. A wideband embedded armor antenna, comprising:

an armor layer mounted to an electrically conductive surface;

a driven dipole in one plane between said armor layer and said electrically conductive surface;

a parasitically driven dipole in a second plane between said driven dipole and the electrically conductive surface and spaced from the electrically conductive surface with an air gap, said second parasitically driven dipole spaced by said air gap from said driven dipole capacitively coupling said driven dipole to said second parasitically driven dipole, said second parasitically driven dipole having two segments;

a resistor between said two dipole segments, wherein said resistor and said capacitive coupling form an RC circuit that lowers the frequency of said antenna, whereby said RC circuit tunes out inductance that causes destructive interference and diminishes gain, such that said antenna can operate in close proximity to said electrically conductive surface without shorting out said antenna;

a feed for said driven dipole which does not pierce said armor layer; and wherein a gain across a frequency band associated with said dipoles is at least −1 dBi.

14. The antenna of claim 13, and further including a resistor between the elements of said driven dipole.

15. A wideband embedded armor antenna, comprising:

an armor layer mounted to an electrically conductive surface of an armored vehicle; a driven dipole in one plane between said armor layer and said vehicle;

a first parasitically driven dipole in a second plane on the outside of said armor layer said dipole operating in the UHF band; a second parasitically driven dipole in a third plane between said driven dipole and the surface of said vehicle, said second parasitically driven dipole spaced from said driven dipole capacitively coupling said driven dipole to said second parasitically driven dipole, said second parasitically driven dipole having two segments and a resistor between said two dipole segments, wherein said resistor and said capacitive coupling form an RC circuit that lowers the frequency of said antenna, whereby said RC circuit tunes out inductance that causes destructive interference and diminishes gain, such that said antenna can operate in close proximity to said electrically conductive surface without shorting; and, a feed for said driven dipole which does not pierce said armor layer, said dipoles including bowtie shaped elements; and wherein a gain across a frequency band associated with said dipoles is at least −1 dBi.

16. The antenna of claim 15, wherein said bowtie shaped elements are in the form of triangularly-shaped elements.

17. The antenna of claim 15, and further including a resistor between the dipole segments of each of said dipoles.

18. The antenna of claim 17, wherein the values of said resistors are 610 ohms for the driven dipole, 640 ohms for said first parasitically driven dipole, and 485 ohms for said second parasitically driven dipole.

19. The antenna of claim 15, wherein the length of said driven dipole is 12.9 inches, the length of said first parasitically driven dipole is 8.2 inches and the length of said second parasitically driven dipole is IOM inches.

20. The antenna of claim 15, wherein said second parasitically driven element is air gap spaced from the surface of said vehicle.

21. The antenna of claim 20, wherein said air gap is between 2 and 2-¼ inches.

* * * * *